United States Patent [19]

Smith

[11] Patent Number: 4,723,664

[45] Date of Patent: Feb. 9, 1988

[54] REINFORCED DISPLAY STAND FOR SUPPORTING HEAVY LOADS

[75] Inventor: Jerrold A. Smith, Plainview, N.Y.

[73] Assignee: Arrow Art Finishers Co., Bronx, N.Y.

[21] Appl. No.: 30,433

[22] Filed: Mar. 26, 1987

[51] Int. Cl.[4] ..... A47C 5/11

[52] U.S. Cl. ..... 211/149; 211/132; 248/174

[58] Field of Search ..... 211/132, 149, 195, 72; 248/174; 206/44, 45, 45.2, 45.24

[56] References Cited

U.S. PATENT DOCUMENTS

| | | | |
|---|---|---|---|
| 2,344,182 | 3/1944 | Taylor | 206/44 R X |
| 2,645,353 | 7/1953 | Anderson | 206/44 R X |
| 2,713,984 | 7/1955 | Paige | 248/174 |
| 2,920,852 | 1/1960 | Hennessey | 248/174 |
| 3,300,166 | 1/1967 | Wojciechowski | 248/174 |
| 3,721,413 | 3/1973 | Robinson | 248/174 |
| 3,738,604 | 6/1973 | Howlett et al. | 248/174 X |
| 4,311,100 | 1/1982 | Gardner et al. | 211/149 X |
| 4,570,805 | 2/1986 | Smith | 211/149 |

*Primary Examiner*—Robert W. Gibson, Jr.

[57] ABSTRACT

A foldable, self-erectable stand has a shelf supported and automatically reinforced by panels below the shelf to prevent shelf sagging.

12 Claims, 18 Drawing Figures

FIG. 4
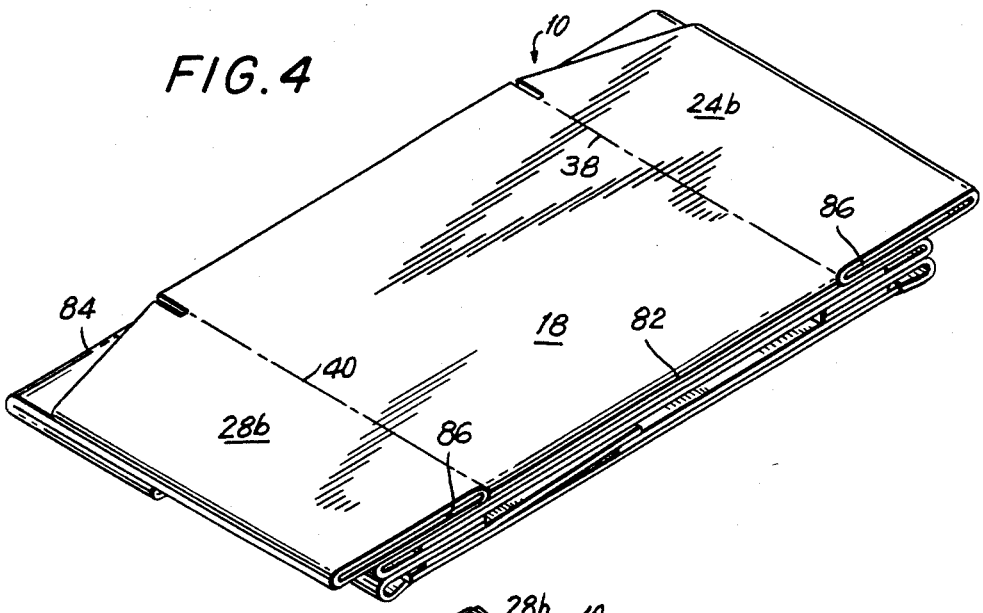
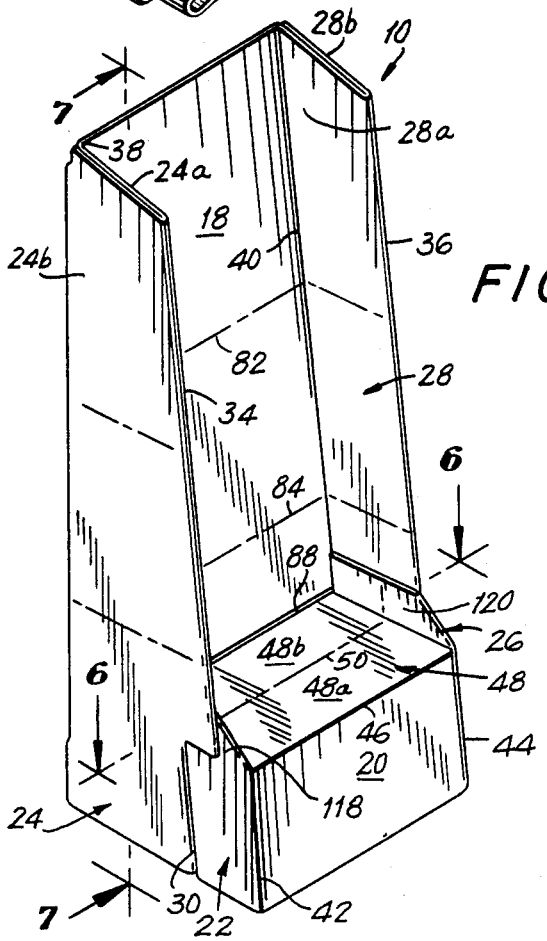
FIG. 5

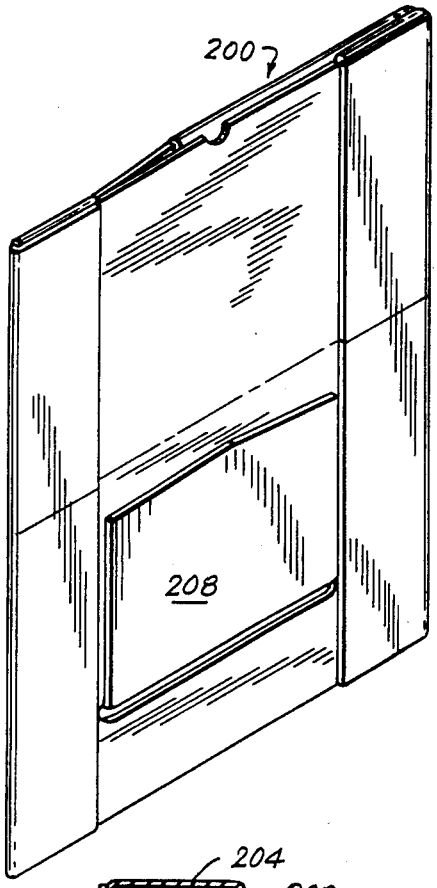
FIG. 14
FIG. 15
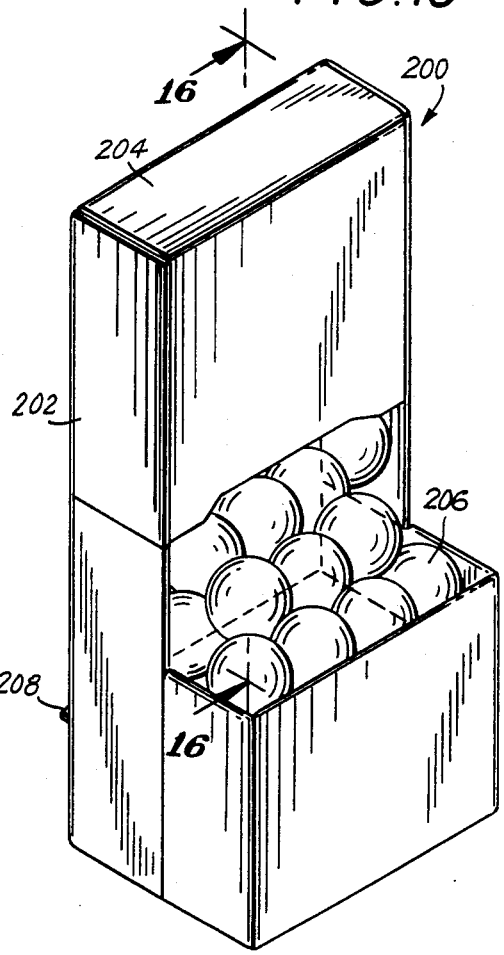
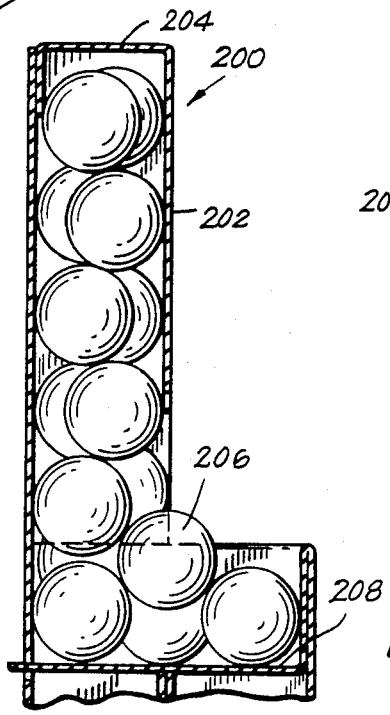
FIG. 16

REINFORCED DISPLAY STAND FOR SUPPORTING HEAVY LOADS

BACKGROUND OF THE INVENTION

1. Field of the Invention

This invention generally relates to foldable, self-erectable display stands and, more particularly, to such stands made of cardboard or similar material but which, nevertheless, can sustain and withstand substantial weights of articles placed on display on the stand.

2. Description of Related Art

Foldable, self-erectable display stands are already known. See, for example, U.S. Pat. Nos. 4,493,424 and 4,570,805, and Reissue U.S. application Ser. No. 927,549 filed November 6, 1986.

Although generally satisfactory for their intended use of displaying articles, experience has shown that the conventional display stand constructions are not altogether acceptable when the stand is called upon to display articles of substantial weight, e.g. vertically and horizontally stacked beer cans and soda bottles. Over time, the known stands and, more specifically, the shelves on which the heavy articles are mounted, sag in use, thereby interfering with the intended display function.

SUMMARY OF THE INVENTION

1. Objects of the Invention

It is a general object of this invention to provide a display stand of the foldable, self-erectable type which is so sturdy as to sustain and withstand substantial weights of the articles on display.

Another object of this invention is to resist a display stand from sagging under heavy loads.

A concomitant object of this invention is to devise the display stand of the above type to be simple in construction, inexpensive to manufacture, easy to use, durable and reliable in operation, nevertheless.

2. Features of the Invention

In keeping with these objects and others which will become apparent hereinafter, one feature of this invention resides, briefly stated, in a foldable display stand erectable, when unfolded, from a collapsed condition to an erect display condition.

The stand comprises a shelf movable from a first position in the collapsed condition, to a load-bearing second position in the erect display condition of the stand. Shelf support means are movable from a shelf non-supporting position in the collapsed condition, to a shelf-supporting position in which the shelf support means lies underneath the shelf and supports the shelf from below the shelf in the erect display condition.

The stand also comprises, in accordance with the invention, reinforcement means movable from a shelf non-reinforcing position in the collapsed condition, to a shelf-reinforcing position in which the reinforcement means lies underneath the shelf and reinforces the shelf from below the shelf in the erect display condition. Biasing means are provided for affirmatively biasing the shelf support means toward the shelf-supporting position, and for affirmatively biasing the reinforcement means toward the shelf-reinforcing position, and for automatically moving the shelf to the load-bearing second position when the stand is unfolded from the collapsed condition.

Hence, the shelf so supported and reinforced can sustain and withstand substantial weights of articles loaded on the shelf for display purposes. Shelf sagging under loads of the kind commonly found in supermarkets and other retail establishments is minimized.

In one preferred construction, the display stand includes generally planar front and rear panels juxtaposed with each other in the collapsed condition and spaced apart in mutual parallelism from one another in the erect condition. Generally planar side panels extend between the front and rear panels at opposite sides of the stand. Each side panel is foldable along a fold line to form a pair of side panel portions which are juxtaposed with each other in the collapsed condition and coplanar in the erect condition.

The shelf support means includes a pair of support panels movable toward and away from each other in a common plane which extends generally perpendicular to the shelf, which itself lies in a plane, in the erect condition. Each support panel includes a pair of intermediate support panel portions, each hingedly connected to a respective side panel portion.

The biasing means is advantageously constituted by an energy storing element such as a circumferentially complete rubber band, opposite arcuate ends of which are frictionally received in slits formed in the support panels. In the collapsed condition, the side panel portions are folded and moved away from each other, thereby jointly moving the support panels apart and, in turn, stretching the band. When the stand is unfolded, the energy stored in the stretched band is released suddenly, thereby suddenly moving the support panels closer together and, in turn, unfolding the side panels to their coplanar state.

As the side panels unfold, the front panel is moved away from the rear panel. The shelf participates in the movement of the front panel due to a hinged connection between the front panel and the shelf. The shelf is therefore suddenly moved to its load-bearing second position with a snap-type action. At the same time, the support panels are deployed underneath the shelf and support the same.

In accordance with this invention, the biasing means also automatically deploys the reinforcement means underneath the shelf so as to prevent the latter from sagging under heavy loads. The reinforcement means is advantageously mounted on the support panels and participates in the movement of the same. Preferably, the reinforcement means includes a pair of reinforcement panels and a pair of connecting panels, together forming a quadrilateral-shaped reinforcement member. The reinforcement panels are slit and mounted on the support panels. In the erect condition, the reinforcement panels extend generally parallel to each other and generally perpendicularly to the support panels; the connecting panels extend generally parallel to each other and generally perpendicularly to the reinforcement panels. The connecting panels lie adjacent and generally parallel to the front and the rear panels in the erect condition. The upper edges of the reinforcement member have a quadrilateral outline and reliably support the shelf along its periphery by engaging marginal edge regions of the shelf. The so-reinforced shelf can hold multiple articles stacked vertically one above another on the shelf.

The shelf, as previously mentioned, is hingedly connected to the front panel at a front edge region. A rear edge region of the shelf can be hingedly secured to the rear panel. In one variant, the rear edge region or flap is glued or otherwise secured to a front surface of the rear panel. A transverse slot may be formed in the rear panel and, in accordance with another variant, the shelf is passed through the slot, and the flap is glued or otherwise secured to a rear surface of the rear panel. In still another variant, the flap is not secured, but is merely left free and overlies the front surface of the rear panel. In this case, the reinforcement member and, more particularly, the rear connecting panel captures the flap between itself and the rear panel and acts to press the flap against the rear panel, thereby securing the flap in position.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 4 is a perspective view of the display stand assembled from the preforms of FIGS. 1–3 in a collapsed condition;

FIG. 5 is a perspective view of the display stand of FIG. 4 in an erect condition;

FIG. 14 is a perspective view of still another display stand in a collapsed condition in accordance with this invention;

FIG. 15 is a perspective view of the display stand of FIG. 14 in an erect condition; and FIG. 16 is a sectional view taken on line 16—16 of FIG. 15.

DETAILED DESCRIPTION OF THE PREFERRED EMBODIMENTS

Figure 1:
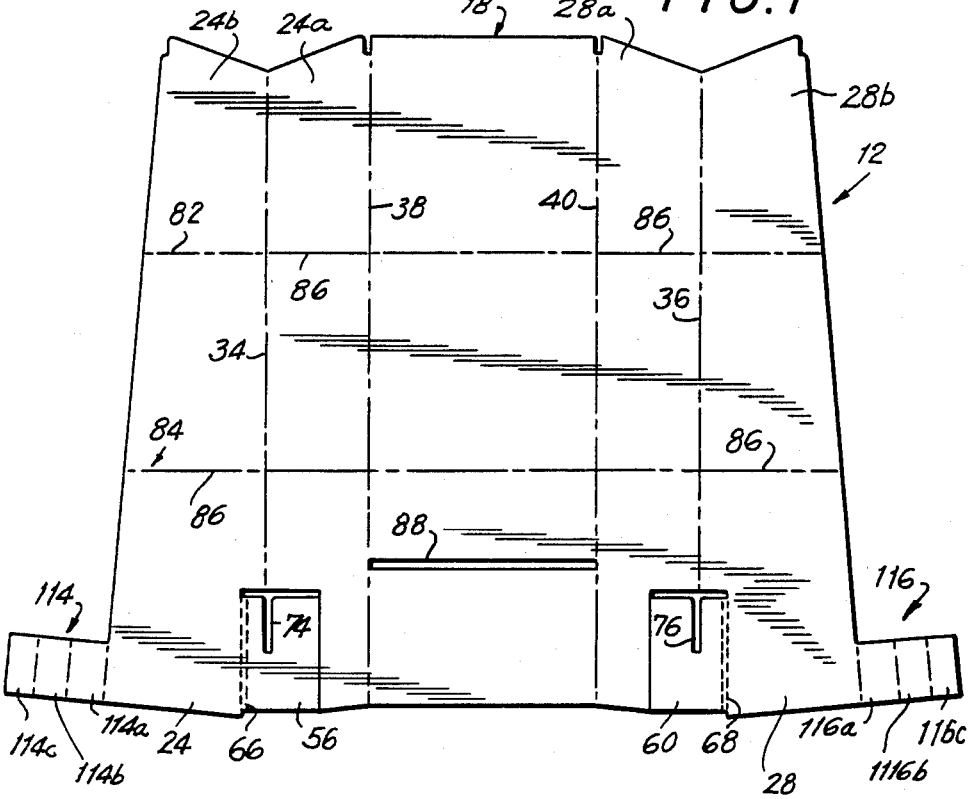
FIG. 1 is a developed view of a single sheet preform from which part of a display stand in accordance with this invention is assembled.

Referring now to FIGS. 1–7, reference numeral 10 in FIGS. 4 and 5 identify a first embodiment of the invention in a collapsed condition and an erect display condition, respectively. This display stand is assembled from single sheet preforms 12, 14, 16, respectively, shown in FIGS. 1–3. Each preform is made advantageously of cardboard or corrugated board. For ease of description, when reference is made to particular directions, it is to be understood that such designations are valid only with respect to the stand in the erect condition, i.e. its condition of use.

Figure 6:
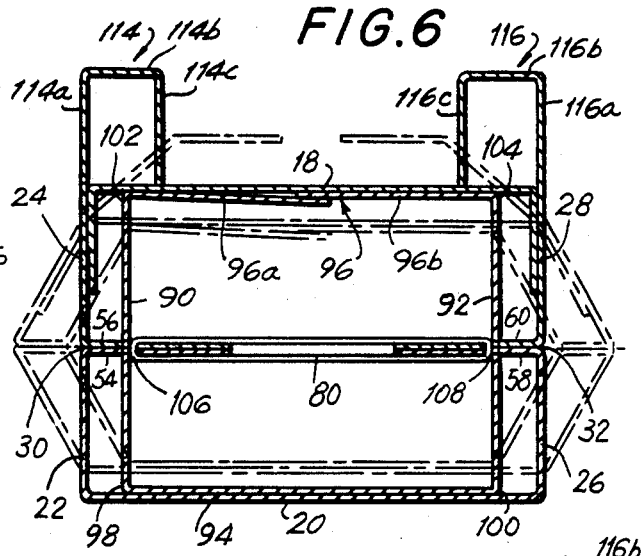
FIG. 6 is an enlarged sectional view taken on line 6—6 of FIG. 5.

The stand 10 includes a planar back panel 18 and a planar front panel 20 spaced apart of each other in mutual parallelism and both being rearwardly inclined (see FIG. 7) at a slight angle from the vertical. Side panel portions 22, 24 together comprise one side panel which extends between the front and rear panels at one side of the stand. Side panel portions 26, 28 together comprise another side panel which extends between the front and rear panels at the opposite side of the stand. As best shown in solid lines in FIG. 6, which depicts the erect condition, side panel portions 22,24 are coplanar with each other; side panel portions 26, 28 are coplanar with each other; and side panel portions 22, 24 are parallel to side panel portions 26, 28. The phantom lines in FIG. 6 depict the various panel portions about midway between the erect and collapsed condition and, as shown, side panel portions 22, 24 are foldable about fold line 30 at which side panel portions 22, 24 meet; and side panel portions 26, 28 are foldable about fold line 32 at which side panel portions 26, 28 meet.

Side panel portion 24 has upper regions **24*a*, 24*b* folded over each other along fold lines 34 and connected to each other, e.g. by stapling or glueing, to form a more rigid side panel. Similarly, side panel portion 28 has upper regions 28*a*, 28*b* folded over each other along fold line 36 and connected to each other to form a more rigid side panel. The rear panel 18 has longitudinal edges 38, 40 hingedly connected to upper regions 24*a*, 28*a* of the side panel portions 24, 28**.

Figure 2:
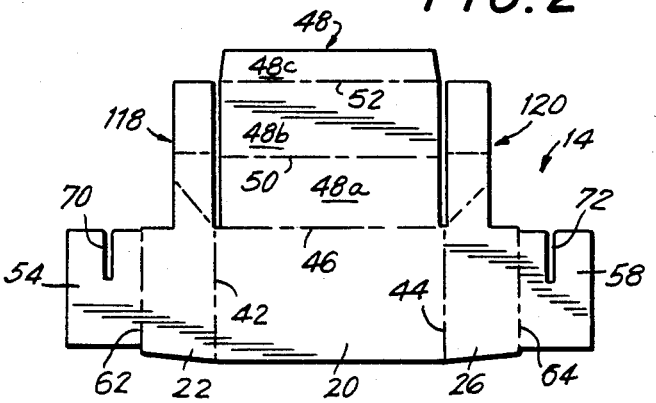
FIG. 2 is a developed view of a single sheet preform from which another part of the display stand in accordance with this invention is assembled.
Figure 3:
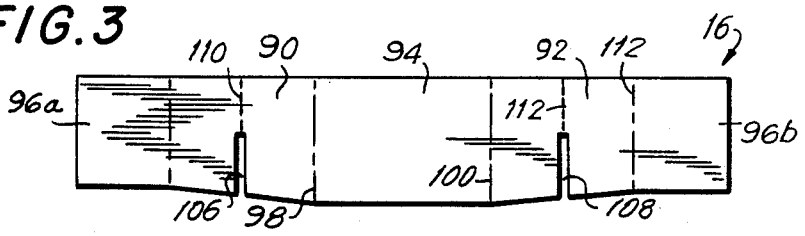
FIG. 3 is a developed view of a single sheet preform from which still another part of the display stand in accordance with this invention is assembled.

As shown in FIGS. 2 and 5, the front panel 20 has upright edges 42, 44 hinged to side panel portions 22, 24. The front panel 20 also has a transverse front edge 46 hinged to a shelf 48 having a front shelf portion **48*a*, a rear shelf portion 48*b* and an end flap 48*c*. Front shelf portion 48*a* is foldable along fold line 50 to rear shelf portion 48*b* which, in turn, is foldable along fold line 52 to end flap 48*c***.

Support panel portions 54, 56 together comprise one support panel lying underneath one side of the shelf in the erect condition. Support panel portions 58, 60 together comprise another support panel lying underneath the opposite side of the shelf in the erect condition. As shown in solid lines in FIG. 6 depicting the erect condition, support panel portions 54, 56 are interconnected, e.g. by stapling or glueing, and lie in a common plane with support panel portions 58, 60 which are likewise interconnected to each other. Support panel portions 54, 58, as shown in FIG. 2, are hinged along fold lines 62, 64 to side panel portions 22,26. Support panel portions 56, 60, as shown in FIG. 1, are hinged along fold lines 66, 68 to side panel portions 24, 28. As depicted by phantom lines in FIG. 6, the support panel portions 54, 56 and 58, 60 move away from each other during movement toward the collapsed condition, and vice versa. All the support panel portions 54, 56, 58, 60 have upper edges lying in said common plane, along which fold lines 30, 32 also lie. The shelf lies on, and is supported by, these upper edges.

Slots 70, 72, 74, 76 are respectively formed in support panel portions 54, 58, 56 and 60. Biasing means, e.g. a circumferentially complete rubber band 80, has one arcuate end received in aligned slots 70, 74, and another end received in aligned slots 72, 76. The band 80 is an energy storing elastomeric element which is stretchable to a high tensioned, stretched state in the collapsed condition, and returnable to a less tensioned, more relaxed state in the erect condition. Rather than a circumferentially complete band, an elastic strap or ribbon can have its opposite ends connected to the support panels.

The stand also has at least one, and in this case two, transverse fold lines 82, 84 about which the stand is folded in opposite directions for compact storage in the collapsed condition of FIG. 4. To facilitate such folding about fold lines 82, 84, each fold line 82, 84 includes crease lines shown by dot-dashed lines in FIG. 1 and slits or cuts 86 shown by solid lines in FIGS. 1 and 4.

Figure 7:
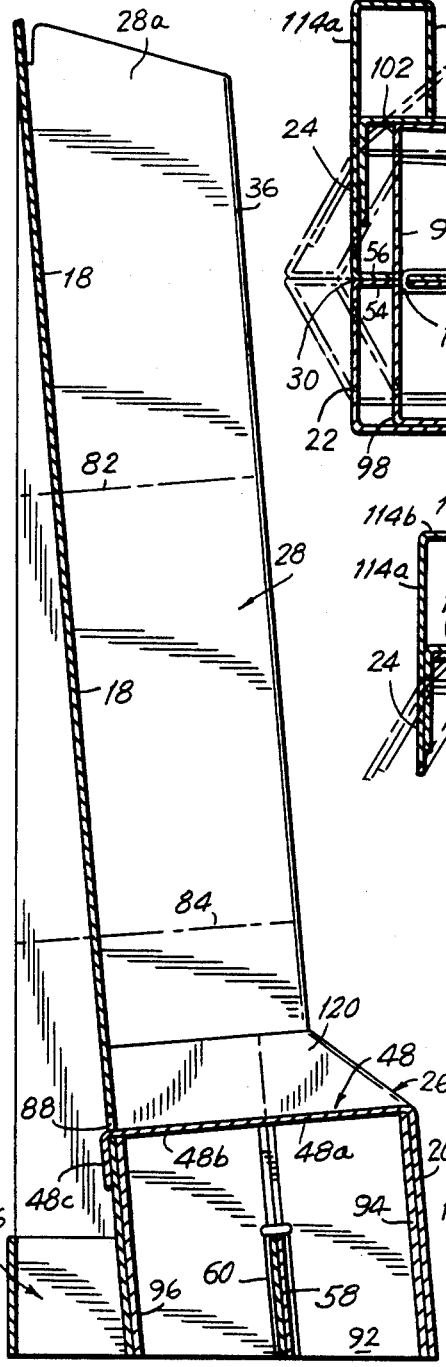
FIG. 7 is an enlarged sectional view taken on line 7—7 or FIG. 5.
Figure 7A:
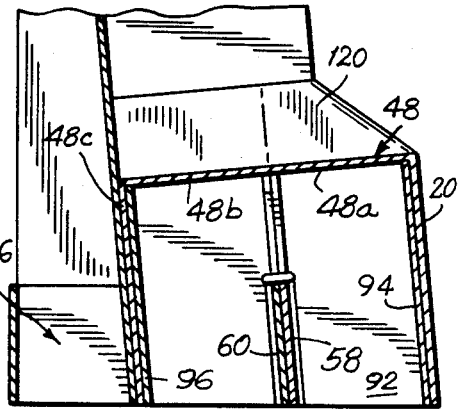
FIG. 7A is a view analogous to FIG. 7, but of the variant construction of FIG. 6A.
Figure 8:
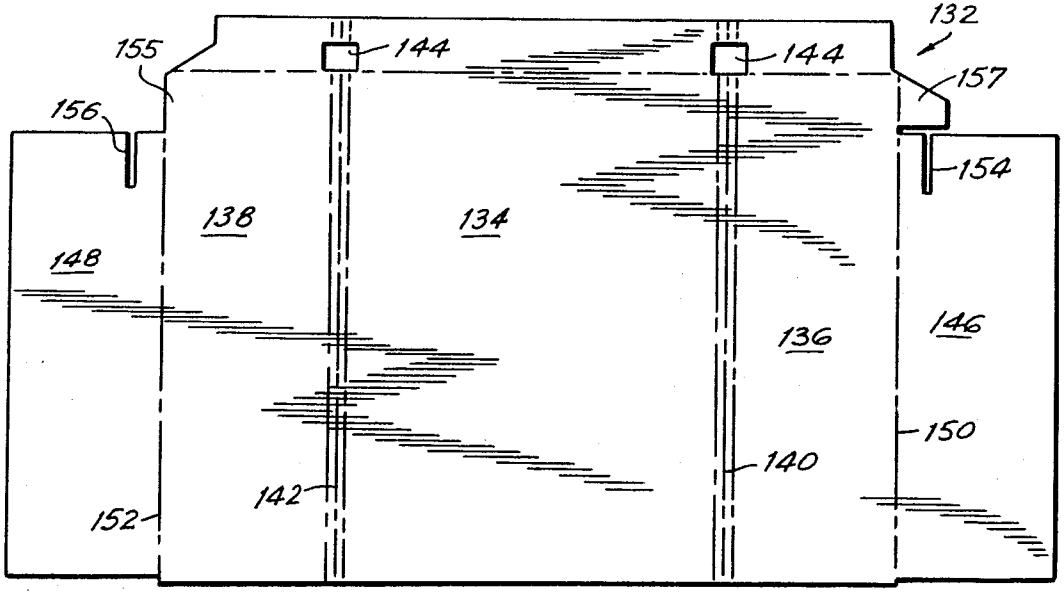
FIG. 8 is a developed view of a single sheet preform from which part of another display stand in accordance with this invention is assembled.
Figure 9:
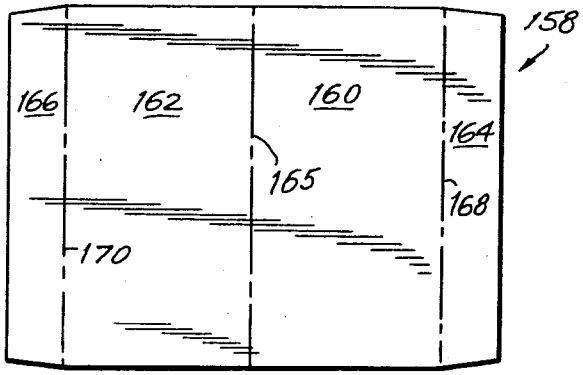
FIG. 9 is a developed view of a single sheet preform from which another part of another display stand is assembled together with the preform of FIG. 8.

A transverse slot 88 extends across the width of rear panel 18. As shown in FIG. 7, the shelf 48 passes through the slot and is supported by the surfaces bounding the slot. The flap **48*c* can be left free in the slot 88. In a variant construction, the flap 48*c* can be bent and secured, e.g. by glueing or stapling, to the rear surface of the rear panel as shown in FIG. 7. In another variant, the flap 48*c* can be similarly bent and secured to the front surface of the rear panel, in which case, the slot 88 is not necessary. In still another variant, the flap 48*c*, as shown in FIG. 7A, can be bent in front of the front surface of the rear panel, but not secured thereto, in which case, the slot 88** is again not needed.

As described so far, the display stand is erected merely by snapping it into its erect condition. First, the upper part of the display stand above fold line 82 is unfolded from its collapsed condition in which it is juxtaposed with the middle and lower parts of the display stand. Concomitantly, the middle part between fold lines 82, 84 is unfolded from its collapsed condition in which it is juxtaposed with the lower part below fold line 84. A slight outside force may then be exerted on the display stand to urge the side panels toward the front panel with simultaneous unfolding of the side panel portions. Only slight unfolding of the side panel portions need be accomplished by the outside force, since then the biasing means 80 will take over and cause the side panel portions to move toward each other and fully unfold. Since the front panel 20 is hinged to the side panels, the front panel 20 will be moved forwardly away from the rear panel 18 as a result of the movement of the side panels caused by the biasing means 80. Since the shelf 48 is hinged to the front panel 20, the shelf 48 will likewise be moved from a first position (FIG. 4) in which the shelf 48 is juxtaposed flat with the other panels, to a second load-bearing position (FIG. 5) in which the shelf lies in a slightly inclined plane to the horizontal which extends generally normal of the rear panel 18. In the FIG. 7 construction, the shelf 48 in its first position is folded onto itself with front shelf part **48*a* juxtaposed with rear shelf part 48*b*, and with fold line 50 higher in elevation than fold lines 46, 52. In the erect condition, the front and rear shelf parts 48*a*, 48*b*** unfold to a common panel on which articles to be displayed are stacked.

Concomitantly, the support panels 54, 56 and 58, 60, which are hinged to the side panels, are moved toward each other in a common plane as a result of the side panel movement caused by the biasing means. Hence, the shelf is automatically supported from below by resting on the upper edges of the support panel portions.

Now, in accordance with the invention, the shelf is reinforced to sustain and withstand substantial weights of articles loaded on the shelf. Shelf sagging is resisted by the provision of a reinforcement 16, shown in developed view in FIG. 3. Reinforcement 16 includes a first pair of reinforcing panels 90, 92 and a second pair of connecting panels 94, 96. Connecting panel 94 is hinged along fold lines 98, 100 to reinforcing panels 90, 92, respectively. Connecting panel 96 is advantageously formed of two connecting panel parts **96*a*, 96*b* which are respectively hinged along fold lines 102, 104 to reinforcing panels 90, 92. Connecting panel parts 96*a*, 96*b* are connected together at their free ends by glueing or stapling to form a rectangular reinforcement, as shown more clearly in FIG. 6**.

Panels 90, 92 are formed with cutouts 106, 108 to facilitate the mounting of the reinforcement 16 onto the support panel portions. More specifically, cutout 106 frictionally receives marginal portions of support panel portions 54, 56; and cutout 108 frictionally receives marginal portions of support panel portions 58, 60. Connecting panel 94 is positioned adjacent, and preferably in contact with, front panel 20. Connecting panel 96 is positioned adjacent, and preferably in contact with, rear panel 18. By being mounted on the support panel portions, the reinforcing panels participate jointly in their movement. The reinforcing panels lie perpendicular to the support panel portions and parallel to the side wall portions. Indeed, the reinforcing panels fold and unfold in the same manner as the side wall portions and, to facilitate such movement, folding lines 110, 112 are formed in the reinforcing panels, and lie in the common plane in which the aforementioned fold lines 30, 32 lie.

The connecting panels 94, 96, by reason of their hinged connection to the reinforcing panels 90, 92, are moved toward and away from each other in a manner analogous to that of the front and rear panels.

Hence, in accordance with this invention, the biasing means not only acts to deploy the shelf and to position shelf support panels thereunder, but also automatically positions reinforcing and connecting panels underneath the shelf and about its entire perimeter. The upper edges of the reinforcing and connecting panels support the shelf and resist sagging when heavy loads are loaded on the shelf.

Figure 6A:
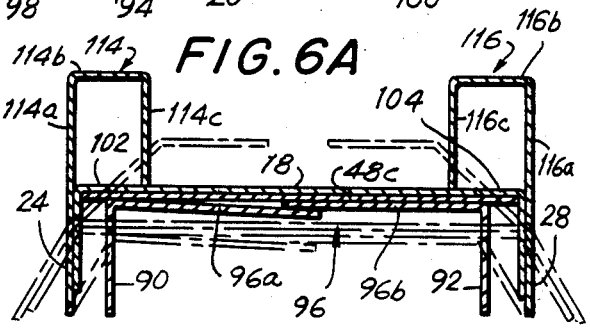
FIG. 6A is a view analogous to FIG. 6, but of a variant construction.

As best shown in FIGS. 6A and 7A, the connecting panel 96 also serves to press the flap **48*c* of the shelf against the front surface of the rear panel 18 to help secure the free flap 48*c* in that position, thereby eliminating the step of fixedly securing the flap 48*c*** in other construction variants.

Returning to FIG. 7, the rearward tilt of the rear panel 18 relative to the vertical and of the shelf 48 relative to the horizontal is compensated by providing rear tubular extensions 114, 116 at opposite rear corners of the stand. Extensions 114, 116 include foldable panel sections **114*a*, 114*b*, 114*c* and 116*a*, 116*b*, 116*c*, respectively which, when folded into a closed tube having a rectangular cross-section (see FIG. 6**) is extremely sturdy and resists tipping of the stand.

To collapse the reinforced display stand of this invention, side panel portions 24, 28 are swung outwardly, overcoming the force of the biasing means, until the side panel portions 24, 28 are situated substantially in the same plane as the rear panel 18. This action causes the side panel portions 22, 26 to fold over onto the side panel portions 24, 28. In turn, the support panel portions 54, 56 and 58, 60 are moved outwardly of each other, and the reinforcing panels 90, 92 are folded in a manner corresponding to the side panel portions. The front panel 20 is moved toward the rear panel 18, and the connecting panels 94, 96 are likewise moved toward each other.

With all the panels so juxtaposed in a flat collapsed condition, the aforementioned upper and middle parts of the stand are folded over the fold lines 82, 84 onto the lower part, thereby rendering the stand very compact. This folding tends to resist the action of the biasing means which tends to constantly urge the stand to its erect condition. Clamps, ropes or analogous holders can also be used to prevent the stand from "popping open" accidentally.

The stand is initially assembled with the three preforms 12, 14, 16, the biasing means being mounted last. For increased lateral support, shoulder panels 118, 120 are provided on preform 14 and, after assembly, extend upwardly above the shelf 48 at opposite sides thereof. The shoulder panels provide additional front-to-back support.

Figure 10:
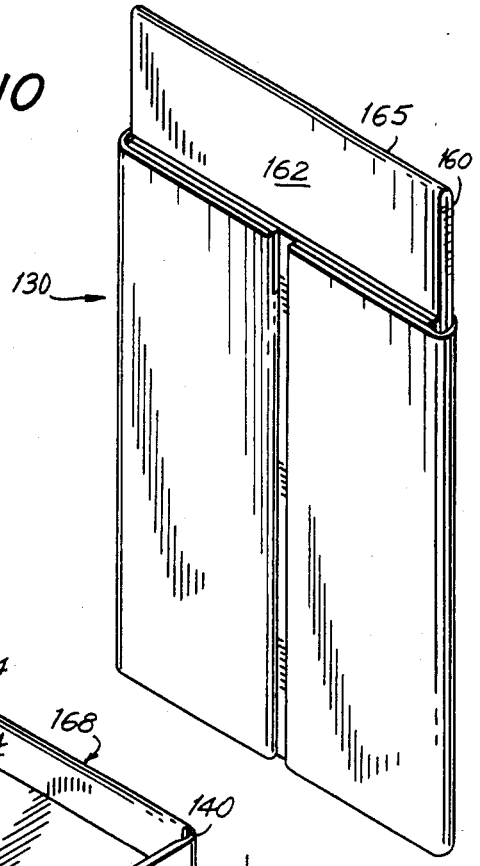
FIG. 10 is a perspective view of the display stand assembled from the preforms of FIGS. 8 and 9 in a collapsed condition.
Figure 11:
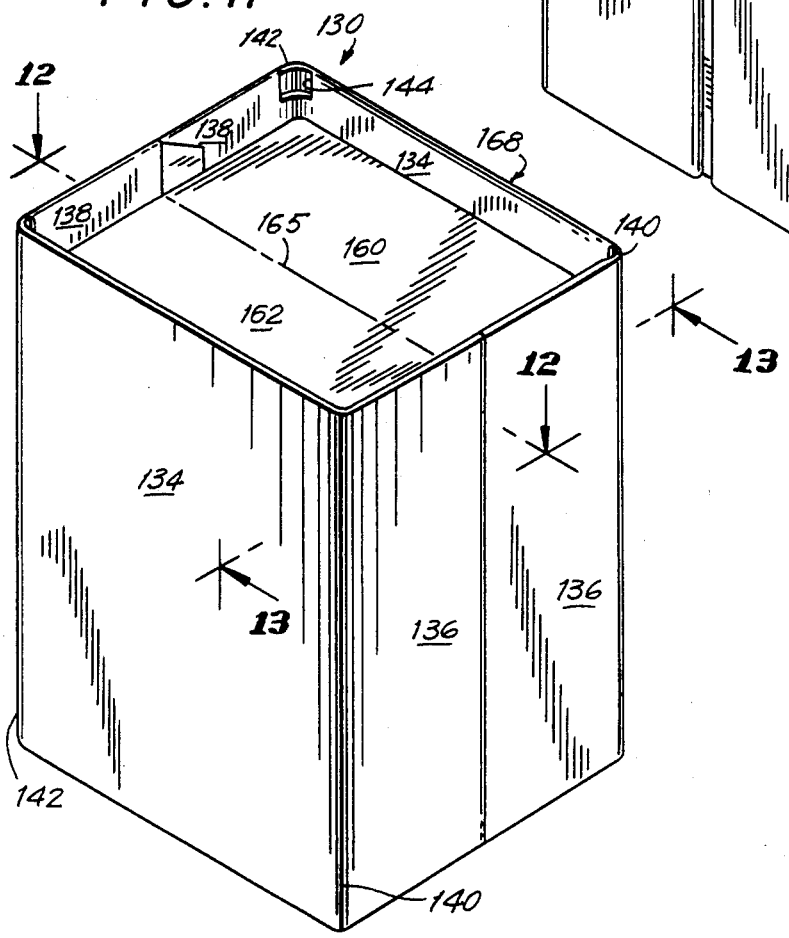
FIG. 11 is a perspective view of the display stand of FIG. 10 in an erect condition.

Turning now to a second embodiment of a reinforced display stand 130, as depicted in FIGS. 8–13, the stand 130 is shown in the collapsed condition in FIG. 10 and in the erect condition in FIG. 11. Stand 130, also known as a dump bin, includes a pair of mirrorsymmetrical halves, each formed by folding a preform 132 shown in FIG. 8. Each preform 132 has a central panel 134 and two side panel portions 136, 138 hinged to central panel 134 along fold lines 140, 142. Additional crease lines on either side of the fold lines 140, 142, as well as cutouts 144, facilitate the folding.

Each preform 132 also has shelf support panels 146, 148 hinged to side panel portions 136, 138 along fold lines 150, 152. Slots 154, 156 are cut out of shelf support panels 146, 148.

The two preforms are interconnected by securing side panel portions 146 to each other, and by securing side panel portions 148 to each other. The assembled preforms have a rectangular cross-section. The shelf support panels extend in a common plane midway between the central panels in the erect condition (see FIG. 12). Flap 157 is secured to area 155 to assist in maintaining the preforms together.

A shelf preform 158 has shelf panels 160, 162 foldable along fold line 165, and end flaps 164, 166 foldable along fold lines 168, 170. The shelf preform is fitted into an open upper end of the assembled preforms. The shelf panels 160, 162 rest on, and are supported by, upper edges of the shelf support panels 146, 148. The shelf panels lie in a plane spaced slightly downwardly from upper edges of the preforms 132, thereby forming a raised border 168 around the entire perimeter of the shelf panels 160, 162. Articles placed on the shelf panels in the erect condition are prevented from falling off by the border 168.

Figure 12:
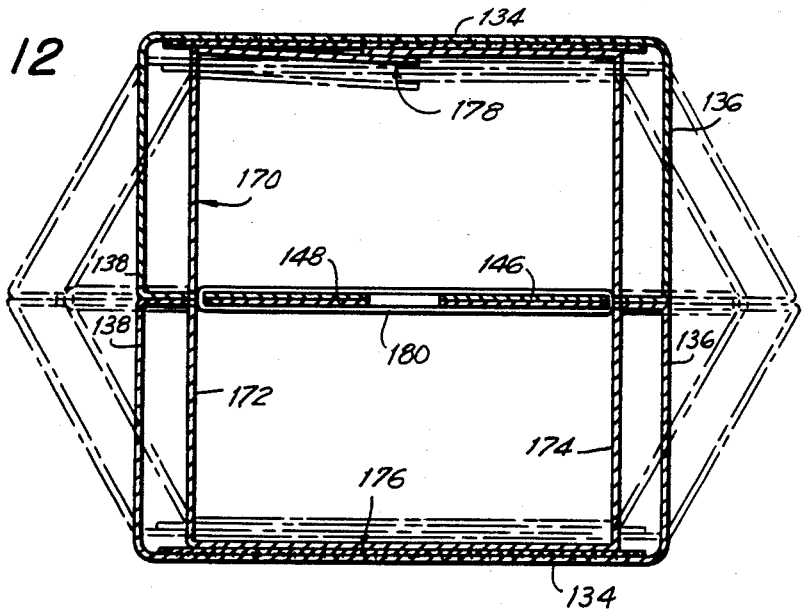
FIG. 12 is a sectional view taken on line 12—12 of FIG 11.
Figure 13:
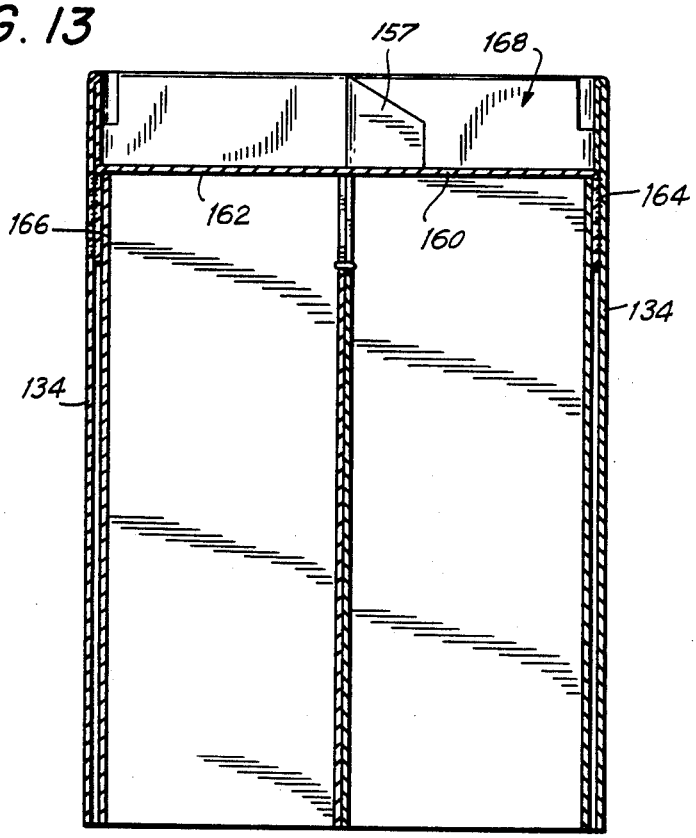
FIG. 13 is a sectional view taken on line 13—13 of FIG. 12.

As shown in FIG. 12, a reinforcement 170, including a pair of reinforcing panels 172, 174 identical to previously mentioned reinforcing panels 90, 92, as well as a pair of connecting panels 176, 178 identical to previously mentioned connecting panels 94, 96, is mounted on the shelf support portions 148, 146. As shown in FIG. 13, connecting panels 176, 178 press end flaps 164, 166 against central panels 134, 134.

The assembly is completed by mounting a biasing means, e.g. a rubber band 180, in slots 154, 156. In a manner identical to that described above, starting from the collapsed condition, by slightly moving the side panel portions 136, 138 toward each other, the band 180 soon takes over and suddenly moves the side panel portions into mutual parallelism. Concomitantly, the shelf support panels 146, 148 are moved toward each other, and the reinforcing panels unfold in the same manner as the side panel portions. The shelf is reliably supported from below and can safely withstand heavy loads.

In still another variant construction, rather than reinforcing an upright display stand having a low shelf on which goods are stacked, or reinforcing a dump bin having an elevated shelf, this invention also proposes reinforcing a gravity-feed display stand 200 of the type shown in FIGS. 14–16, which stand is shown in collapsed condition in FIG. 14 and in erect condition in FIG. 15. Stand 200 includes an overhead chute 202 having an openable end cover flap 204 through which goods, such as balls 206, are admitted, thereby descending under the influence of gravity to be supported on shelf 208. As goods 206 are removed from the shelf, additional goods previously stored in the chute fall to take their place. The shelf 208 is supported and reinforced in the same manner described above by reinforcing and connecting panels so as to prevent the shelf 208 from sagging.

It will be understood that each of the elements described above, or two or more together, also may find a useful application in other types of constructions differing from the types described above.

While the invention has been illustrated and described as embodied in a reinforced display stand for supporting heavy loads, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A foldable display stand erectable, when unfolded, from a collapsed condition to an erect display condition, comprising:

(a) a shelf movable from a first position in the collapsed condition to a load-bearing second position in the erect display condition of the stand;

(b) shelf support means movable from a shelf non-supporting position in the collapsed condition, to a shelf-supporting position in which the shelf support means lies underneath the shelf and supports the shelf from below the shelf in the erect display condition;

(c) reinforcement means mounted on the shelf support means for joint movement therewith, and being movable from a shelf non-reinforcing position in the collapsed condition, to a shelf-reinforcing position in which the reinforcement means lies underneath the shelf and reinforces the shelf from below the shelf in the erect display condition; and (d) biasing means for affirmatively biasing the shelf support means toward the shelf-supporting position, and for affirmatively biasing the reinforcement means toward the shelf-reinforcing position, and for the automatically moving the shelf to the load-bearing second position when the stand is unfolded from the collapsed condition, whereby the shelf so supported and reinforced can sustain and withstand substantial weights of articles on display on the shelf.

2. The display stand as recited in claim 1, wherein the shelf includes a shelf panel, and wherein the shelf support means includes a pair of support panels movable toward and away from each other in a common plane which extends generally perpendicular to the shelf panel in the erect condition, and wherein the reinforcement means includes a pair of reinforcement panels mounted on the support panels and extending generally perpendicularly to the support panels and generally parallel to each other in the erect condition.

3. The display stand as recited in claim 2; and further comprising generally planar front and rear panels juxtaposed with each other in the collapsed condition and spaced apart from each other in the erect condition; and wherein the reinforcement panels lie in planes extending between, and generally perpendicular to, the front and rear panels in the erect condition.

4. The display stand as recited in claim 3; and further comprising generally planar side panels extending between the front and rear panels at opposite sides of the stand, each side panel being foldable along a fold line to form a pair of side panel portions which are juxtaposed with each other in the collapsed condition and which are coplanar in the erect condition; and wherein each support panel includes a pair of support panel portions each hingedly connected to a side panel portion.

5. The display stand as recited in claim 3, and wherein the reinforcement means further includes a pair of connecting panels hingedly connected to the reinforcement panels underneath the shelf, said connecting panels being juxtaposed with each other in the collapsed condition and spaced apart in mutual parallelism in the erect condition.

6. The display stand as recited in claim 5, wherein the reinforcement and connecting panels have a quadrilateral upper edge on which the shelf rests in the erect condition.

7. The display stand as recited in claim 2, wherein the reinforcement panels have slots in which the support panels are received.

8. The display stand as recited in claim 2, wherein the biasing means includes an energy storing element mounted on the support panels.

9. The display stand as recited in claim 3, wherein the rear panel is rearwardly inclined relative to the vertical in the erect condition; and further comprising tubular bases at the rear of the rear panel.

10. The display stand as recited in claim 3, wherein the shelf has a front edge region hingedly secured to the front panel, a rear edge region hingedly secured to the rear panel, and front and rear shelf portions foldable about a transverse fold line lying in the common plane of the support panels.

11. The display stand as recited in claim 3, wherein the shelf has a front edge region hingedly secured to the front panel, a rear flap juxtaposed with the rear panel in the erect condition, and wherein the reinforcement means is also operative for securing the rear flap against the rear panel.

12. A foldable display stand erectable, when unfolded, from a collapsed condition to an erect display condition, comprising:

(a) a shelf movable from a first position in the collapsed condition to a load-bearing second position in the erect display condition of the stand;

(d) shelf support means including a shelf support panel movable from a shelf non-supporting position in the collapsed condition, to a shelf-supporting position in which the shelf support panel lies in a predetermined plane underneath the shelf and supports the shelf from below the shelf in the erect display condition;

(c) reinforcement means including a reinforcement panel movable from a shelf non-reinforcing position in the collapsed condition, to a shelf-reinforcing position in which the reinforcement panel lies in a plane generally perpendicular to said predetermined plane underneath the shelf and reinforces the shelf from below the shelf in the erect display condition; and (d) biasing means for affirmatively biasing the shelf support means toward the shelf-supporting position, and for affirmatively biasing the reinforcement means toward the shelf-reinforcing position, and for automatically moving the shelf to the load-bearing second position when the stand is unfolded from the collapsed condition, whereby the shelf so supported and reinforced can sustain and withstand substantial weights of articles on display on the shelf.

* * * * *